US006413293B1

(12) United States Patent
Grearson et al.

(10) Patent No.: US 6,413,293 B1
(45) Date of Patent: Jul. 2, 2002

(54) METHOD OF MAKING ULTRAFINE WC-CO ALLOYS

(75) Inventors: Alistair Grearson, West Midlands; John Aucote, Warks; Michael John Carpenter, Warwickshire, all of (GB)

(73) Assignee: Sandvik AB, Sandviken (SE)

( * ) Notice: Subject to any disclaimer, the term of this patent is extended or adjusted under 35 U.S.C. 154(b) by 0 days.

(21) Appl. No.: 09/486,603

(22) PCT Filed: Sep. 4, 1998

(86) PCT No.: PCT/SE98/01573

§ 371 (c)(1),
(2), (4) Date: Aug. 16, 2000

(87) PCT Pub. No.: WO99/13120

PCT Pub. Date: Mar. 18, 1999

(30) Foreign Application Priority Data

Sep. 5, 1997 (SE) ..... 9703203

(51) Int. Cl.[7] ..... C22C 29/00

(52) U.S. Cl. ..... 75/240; 75/241; 419/15; 419/18

(58) Field of Search ..... 419/18, 15; 75/240, 75/241

(56) References Cited

U.S. PATENT DOCUMENTS

| | | | | |
|---|---|---|---|---|
| 4,539,041 A | | 9/1985 | Figlarz et al. | 75/0.5 A |
| 4,923,512 A | | 5/1990 | Timm et al. | 75/239 |
| 4,925,626 A | * | 5/1990 | Anand et al. | 419/18 |
| 4,956,012 A | * | 9/1990 | Jacobs et al. | 75/236 |
| 5,009,705 A | | 4/1991 | Yoshimura et al. | 75/240 |
| 5,371,975 A | | 12/1994 | Lundmark | 451/9 |
| 5,441,693 A | | 8/1995 | Ederyd et al. | 75/10 |
| 5,619,000 A | | 4/1997 | Ederyd et al. | 75/240 |

FOREIGN PATENT DOCUMENTS

| | | |
|---|---|---|
| AT | 268706 | 2/1969 |
| EP | 0 113 281 A1 | 7/1984 |
| JP | 61-194148 | 8/1986 |
| JP | 8-253836 | 10/1996 |
| JP | 9-78158 | 3/1997 |
| WO | WO 92/13112 | 8/1992 |
| WO | WO 92/18656 | 10/1992 |

* cited by examiner

*Primary Examiner*—Daniel J. Jenkins
(74) *Attorney, Agent, or Firm*—Burns, Doane, Swecker & Mathis, L.L.P.

(57) ABSTRACT

The present invention relates to a method of making ultrafine WC—Co alloys from a well dispersed mixture of fine and non-agglomerated WC and Co powders, wherein the Co powders have a narrow grain size distribution wherein at least 80% of the grains have sizes in the interval x+0.2x with the interval of variation of 0.4x is not smaller than 0.1 um, and a carbon content of approximately the amount necessary to provide eta phase formation.

21 Claims, No Drawings

METHOD OF MAKING ULTRAFINE WC-CO ALLOYS

FIELD OF THE INVENTION

The present invention relates to a method of making ultrafine WC—Co alloys from a well dispersed mixture of fine and non-agglomerated WC and Co powders, optimised grain growth refiner additions and carbon content using low temperature sinter/sinter-HIP conditions.

BACKGROUND OF THE INVENTION

It is well known that decreasing the WC grain size confers performance advantages to cemented carbide in many applications e.g. PCB (Printed Circuit Board) machining, wood machining, metal cutting. Maintaining a submicron WC grain size requires the use of grain growth refiners such as VC, $Cr_3C_2$, TaC etc. The finer the WC grain the greater the necessary addition of said refiners. In some applications e.g. metal cutting fineness of the WC grain size should not greatly reduce toughness, otherwise edge life will suffer. Grain refiners may reduce toughness if used in excessive amounts.

In other applications e.g. PCB machining, fineness of WC grain size is of paramount importance with toughness demand being secondary. Commercially available ultra fine cemented carbide grades already use a grain size of about 0.4 μm. But to reduce the WC grain sizes to below 0.4 μm requires novel raw material and processing technique.

DE 40 00 223 (Mitsubishi) discloses a cemented carbide based on WC with 6–14 wt-% binder phase containing vanadium and chromium whereby the ratio Cr/(Cr+V) is <0.95 and >0.50. U.S. Pat. No. 4,539,041 discloses the making of metallic powders by a process for reducing oxides, hydroxides or metal salts with the aid of polyols. Particularly, when starting with cobalt hydroxide it is possible to obtain powders of metallic cobalt as essentially spherical, non-agglomerated particles. Such Co powder is herein referred as polyol cobalt.

U.S. Pat. No. 5,441,693 discloses a method of making cemented carbide with an extremely uniform structure by using Co-powder produced according to the above mentioned polyol method and with submicron grain size.

SUMMARY OF THE INVENTION

It is an object of the present invention to provide a method of making cemented carbide with WC grain size less than 0.8 μm and with a low content of grain refiners.

In one aspect, the present invention provides a method of making a cemented carbide having a submicron WC grain size, the method comprising the steps of: (i) forming a powder mixture comprising deagglomerated submicron WC produced by carbothermal reaction, Co powder having deagglomerated spherical grains of submicron size with a narrow grain size distribution wherein at least 80% of the grains have sizes in the interval x+0.2x with the interval of variation of 0.4x is not smaller than 0.1 μm, a carbon content of approximately the amount necessary to provide eta phase formation, and <1 wt. % grain growth inhibitor; (ii) milling the powder mixture; and (iii) sintering.

DETAILED DESCRIPTION OF PREFERRED EMBODIMENTS

According to the method of the present invention cemented carbide compositions with extremely fine microstructure, average grain size <0.8 μm, essentially no grains larger than 1.5 μm, suitable for toughness demanding machining operations are made by milling deagglomerated submicron WC powder produced by carbothermal reaction with a cobalt powder having deagglomerated spherical grains of about 0.4 μm average grain size and with a narrow grain size distribution wherein at least 80% of the particles have sizes in the interval x±0.2x provided that the interval of variation (that is 0.4x) is not smaller than 0.1 μm. Preferably the cobalt powder is polyol cobalt. If the carbon content of the powder mixture to be sintered is held close to etaphase formation no, or a relatively low amount (<1 wt-%) of grain growth refiners such as VC and $Cr_3C_2$ need to be added. Sintering with HIP takes place at relatively low temperatures (i.e., <1400° C.). The sintered cemented carbide has a Co-content of 70–85% in terms of cobalt magnetic measurements assuming pure cobalt.

In a preferred method the average WC grain size is further reduced to below 0.4 μm by using an optimum VC+$Cr_3C_2$ addition in which the ratio of VC/$Cr_3C_2$ in wt-% is 0.33–1.0, preferably 0.5–0.9, most preferably 0.7–0.8 for PCB-applications and 0–0.5 for metal cutting, preferably 0–0.2 for non ferrous machining and 0 for ferrous machining. Preferably sintering is performed using gas pressure sintering also referred to as sinter-HIP.

In a first embodiment particularly useful for finish and general machining of non-ferrous materials the cemented carbide has 6–10% Co, 0.0–0.3 VC, 0.3–0.75 $Cr_3C_2$ and rest WC<0.8 μm.

In a second embodiment particularly useful for rough machining in demanding work materials (e.g. austenitic stainless steels) the cemented carbide has 10–16% Co, 0.5–1.2 $Cr_3C_2$ and rest WC<0.8 μm.

In a third embodiment particularly useful for very tough machining operations, or those with very low cutting speed, (e.g. broaching) the cemented carbide has 16–20% Co, 0.8–1.8 $Cr_3C_2$ and rest WC<0.8 μm.

In a fourth embodiment particularly useful for PCB and non-metallic routing and slot drilling, the cemented carbide has 5–8% Co, 0.1–0.6 VC, 0.25–0.6 $Cr_3C_2$ and rest WC<0.4 μm.

In a fifth embodiment particularly useful for PCB micro drilling the cemented carbide has 8–12% Co, 0.2–0.9 VC, 0.4–0.9 $Cr_3C_2$ and rest WC<0.4 μm.

In a sixth embodiment particularly useful for wood-machining of solid wood or fibreboard the cemented carbide has 2–5% Co, 0.05–0.2% VC, 0.1–0.25% $Cr_3C_2$ and rest WC<0.4 μm.

EXAMPLE 1

PCB drill blanks were produced from submicron WC made by carbothermal reaction and milled deagglomerated with cobalt powder having special deagglomerated grains of about 0.4 μm average grainsize and with a narrow grain size distribution and VC+$Cr_3C_2$. The following compositions were made containing in addition to WC:

A. 8 wt-% Co, 0.3 wt-% VC and 0.4 wt-% $Cr_3C_2$ with a carbon content according to the invention. For comparison blanks with the same composition but with carbon content according to prior art.

B. 9 wt-% Co and 0.35 wt-% VC and 0.45 wt-% $Cr_3C_2$ with a carbon content according to the invention. For comparison blanks with the same composition as prior art from A were made.

C. 7 wt-% Co and 0.26 wt-% VC and 0.35 wt-% $Cr_3C_2$ with a carbon content according to the invention. For comparison blanks with the composition (in wt-%) 6.5 Co, 0.6 VC and 0.32 $Cr_3C_2$ according to prior art were made.

The blanks were pressed and sintered with HIP at 1340° C. Magnetic cobalt content, (CoM), coercive force, Hc, were measured and performance was tested in a microdrilling and a routing test.

The microdrilling test was performed under the following conditions:

Drill diameter 0.3 mm

Speed 80000 to 120000 rpm

Feed 15 μm/rev increasing at every 500 hits by 5 μm/rev until failure

Material tested three stacked PCB copper lined FR4 resin

The routing test was performed under the following conditions:

Diameter 2.4 mm

Measurement of wear levels after 50 m routing at speeds ranging from 30000 to 42000 rpm (8 μm tooth at 2.4 mm diameter)

Material three stacked PCB copper lined FR4 resin.

The following results were obtained

| examples: | | CoM | Hc | Tool life ratio of invention with respect to prior art |
|---|---|---|---|---|
| Performance: PCB microdrilling | | | | |
| A. | invention | 5.80 | 38.3 | 1.27 |
| | prior art | 7.34 | 37.0 | 1 |
| B. | invention | 7.33 | 40.5 | 1.59 |
| | prior art | 7.34 | 37.0 | 1 |
| Performance: PCB Routing | | | | |
| C. | invention | 6.04 | 40.7 | 1.1 |
| | prior art | 5.11 | 41.6 | 1 |

EXAMPLE 2

Endmill blanks were produced from submicron WC made by carbothermal reaction and milled deagglomerated with cobalt powder having special deagglomerated grains of about 0.4 μm average grainsize and with a narrow grain size distribution and $Cr_3C_2$. The following compositions were made containing, in addition to WC:

D. 10 wt-% Co and 0.5 wt-% $Cr_3C_2$ with a carbon content according to the invention. CoM was 8.3 and Hc24 kA/m.

E. 12 wt-% Co and 0.6 wt-% $Cr_3C_2$ with a carbon content according to the invention. CoM was 10.6 and Hc 21.5 kA/m.

F. For comparison blanks with 10% Co, 0.5%, $Cr_3C_2$ but with carbon content according to prior art and with 0.8 μm grain size.

The blanks were pressed and sintered at 1360° C. Magnetic cobalt content (CoM) coercive force (Hc) were measured. The blanks were ground to 8 mm diameter endmills PVD coated with TiCN. Performance was tested in an end milling and slotting operation. An edge milling test was performed under the following conditions:

Work piece material: Inconel 718 age hardened

Speed 20 m/min

Feed 0.021 mm/tooth

Depth of cut: 8 mm

Radial depth of cut: 4 mm

Flood coolant

Result

D(Invention) reached 0.9 m cutting distance tool life and the reference F achieved 0.42 m cutting distance.

A slot milling test was performed under the following conditions:

Work piece material: 316 austenitic stainless steel

Speed 50 m/min

Feed 0.042 mm/tooth

Depth of cut: 4 mm

Width of cut: 8 mm

Flood coolant

Result

E(Invention) reached 8.5 m cutting distance tool life and the reference F achieved 5 m cutting distance.

The principles, preferred embodiments and mode of operation of the present invention have been described in the foregoing specification. The invention which is intended to be protected herein, however, is not to be construed as limited to the particular forms disclosed, since these are to be regarded as illustrative rather than restrictive. Variations and changes may be made by those skilled in the art without departing from the spirit of the invention.

What is claimed is:

1. A method of making a cemented carbide having a submicron WC grain size, the method comprising the steps of:

(i) forming a powder mixture comprising deagglomerated submicron WC produced by carbothermal reaction, Co powder having deagglomerated spherical grains of submicron size with a narrow grain size distribution wherein at least 80% of the grains have sizes in the interval x+0.2x with the interval of variation of 0.4x is not smaller than 0.1 μm, a carbon content of approximately the amount necessary to provide eta phase formation, and <1 wt. % grain growth inhibitor;

(ii) milling the powder mixture; and (iii) sintering.

2. Method according to claim 1 adding the VC and $Cr_3C_2$ in such proportions that the ratio $VC/Cr_3C_2$ in wt-% is between 0.33–1.0 for PCB-applications and 0–0.5 for metal cutting.

3. The method of claim 1, wherein the cemented carbide has an average grain size of <0.8 μm, with essentially no grains larger than 1.5 μm.

4. The method of claim 1, wherein the cemented carbide has 6–24 wt. % Co.

5. The method of claim 1, wherein the grain growth inhibitor comprises at least one of VC and $Cr_3C_2$.

6. The method of claim 1, wherein the spherical Co grains have an average grain size of approximately 0.4 μm.

7. The method of claim 1, wherein the Co powder is polyol cobalt.

8. The method of claim 1, wherein the sintering comprises HIP-sintering at a temperature <1400° C.

9. The method of claim 2, wherein the ratio is 0.5–0.9.

10. The method of claim 2, wherein the ratio is 0.7–0.8.

11. The method of claim 2, wherein the ratio is 0.0–0.5.

12. The method of claim 1, wherein the cemented carbide has 5–8 wt. % Co.

13. The method of claim 1, wherein the cemented carbide has 2–5 wt. % Co.

14. The method of claim 1, wherein the cemented carbide has an average grain size <0.4 $\mu$m.

15. A cemented carbide cutting tool made by the process of claim 1.

16. The method of claim 1, wherein step (i) comprises forming a powder mixture containing, in weight %, 6–10% Co, 0.0–0.3% VC, 0.3–0.75% $Cr_3C_3$ and the remainder WC having a grain size <0.8 $\mu$m.

17. The method of claim 1, wherein step (i) comprises forming a powder mixture containing, in weight %, 10–16% Co, 0.5–1.2% $Cr_3C_3$ and the remainder WC having a grain size <0.8 $\mu$m.

18. The method of claim 1, wherein step (i) comprises forming a powder mixture containing, in weight %, 16–20% Co, 0.8–1.8% $Cr_3C_3$ and the remainder WC having a grain size <0.8 $\mu$m.

19. The method of claim 1, wherein step (i) comprises forming a powder mixture containing, in weight %, 5–8% Co, 0.1–0.6% VC, 0.25–0.6% $Cr_3C_3$ and the remainder WC having a grain size <0.4 $\mu$m.

20. The method of claim 1, wherein step (i) comprises forming a powder mixture containing, in weight%, 8–12% Co, 0.2–0.9% VC, 0.4–0.9% $Cr_3C_3$ and the remainder WC having a grain size <0.4 $\mu$m.

21. The method of claim 1, wherein step (i) comprises forming a powder mixture containing, in weight %, 2–5% Co, 0.05–0.2% VC, 0.1–0.25% $Cr_3C_3$ and the remainder WC having a grain size <0.4 $\mu$m.

* * * * *